United States Patent [19]

Cesna

[11] Patent Number: 4,519,168

[45] Date of Patent: May 28, 1985

[54] LIQUID WAXLESS FIXTURING OF MICROSIZE WAFERS

[75] Inventor: Joseph V. Cesna, Niles, Ill.

[73] Assignee: Speedfam Corporation, Des Plaines, Ill.

[21] Appl. No.: 557,904

[22] Filed: Dec. 5, 1983

Related U.S. Application Data

[63] Continuation of Ser. No. 290,615, Aug. 6, 1981, abandoned, which is a continuation of Ser. No. 76,670, Sep. 18, 1979, abandoned.

[51] Int. Cl.[3] ..... B24B 37/04

[52] U.S. Cl. ..... 51/216 LP; 51/237 R; 51/283 R; 51/131.3

[58] Field of Search ..... 51/129, 131.1, 131.3, 51/131.4, 131.5, 216 R, 216 LP, 235, 236, 237, 283 R, 313, 316; 248/362, 363, 467; 269/21

[56] References Cited

U.S. PATENT DOCUMENTS

| | | | |
|---|---|---|---|
| 1,173,538 | 2/1916 | Roberts | 248/362 X |
| 1,621,780 | 3/1927 | Hirsh et al. | 51/316 |
| 3,449,870 | 6/1969 | Jensen | 51/131.4 X |
| 3,453,783 | 7/1969 | Queen | 51/216 LP |
| 3,731,435 | 5/1973 | Boettcher et al. | 51/129 |
| 3,841,031 | 10/1974 | Walsh | 51/283 |
| 4,009,540 | 3/1977 | Uijen | 51/216 LP X |
| 4,081,928 | 4/1978 | Kinnebrew et al. | 51/131.4 |
| 4,132,037 | 1/1979 | Bonora | 51/216 LP X |
| 4,239,567 | 12/1980 | Winings | 51/237 R X |
| 4,258,508 | 3/1981 | Wilson et al. | 51/283 R |

FOREIGN PATENT DOCUMENTS 2802654 8/1978 Fed. Rep. of Germany ..... 51/131.4

*Primary Examiner*—Robert P. Olszewski

*Attorney, Agent, or Firm*—Charles F. Pigott, Jr.

[57] ABSTRACT

The disclosure teaches an improved manner of firmly holding a thin brittle wafer, such as a 0.01" thick silicon disc 3" in diameter, so as to allow the wafer to be brought into abrading contact with a moving lap wheel. The fixturing provides a pedestal ground flat and a pad of resilient but firm cellular material bonded on the pedestal and ground flat also. The pedestal and pad are each sized only slightly larger than the wafer to be lapped. A guide ring surrounds the pedestal and pad, leaving only a slight clearance gap therebetween, and further projects away from the pad a distance less than the thickness of the wafer as it will be after lapping. A special liquid is applied as a thin uniform film over the face of the pad, and the wafer is biased against the pad face with a uniform force sufficient to squeeze the film to near zero thickness and into the open cells or pores of the pad. By using liquid that is water soluble, is hygroscopic, and has high surface tension, such as carbo wax polyethylene glycol or an equivalent from the glycol or glycerine family, the liquid squeezed into the cells of the pad create an adhesion to the wafer for holding the same firmly in place even after the biasing force is removed. The pad preferably is formed of polyurethane, but could be from the family including cellular urethane, Pellon perforated pad K, some hard styrofoam materials, or even polystyrene to provide the needed characteristics of good porosity, firmness and resiliency.

5 Claims, 4 Drawing Figures

LIQUID WAXLESS FIXTURING OF MICROSIZE WAFERS

This is a continuation of application Ser. No. 290,615, filed Aug. 6, 1981, now abandoned, which was a continuation of application Ser. No. 76,670, filed Sept. 18, 1979, now abandoned.

BACKGROUND OF THE INVENTION

Numerous machines have been devised for producing flat surfaces on machined, ground or precision cast work pieces. A common example of such is a lapping machine that has a cylindrical disc-like lap wheel centrally rotated about a vertical axis, and the work piece is adjustably held against the lap wheel. A fixture is used to hold the work piece, or more than one such work piece if the piece is small. Of critical importance in the accurate lapping of small pieces or pieces of a material that is brittle is the means for fixturing the work piece relative to the lap wheel.

One such class of work pieces that is brittle and difficult to handle but yet must be lapped in order to be reliable is the wafer or disc of silicon that is commonly used for the fabrication of solid state circuit components. The wafers are cut or sawed from an elongated rod of silicon and may be 3 inches in diameter and 0.020 inch thick. A complex circuit is formed on one surface of the wafer, and the other side is blank. The wafer is lapped down from the blank side to possibly a thickness of only 0.008 inch. Extreme care must be taken so as not to scratch the circuit side of the wafer during this or a subsequent machining operation.

Various fixturing techniques used in lapping include a wax mounting method, a vacuum system, and several so-called waxless methods.

The wax mounting method requires numerous pieces of auxiliary apparatus and steps to mount the wafer in the fixture before lapping, and then to release the wafer after the lapping operation. As an example, a heater is used to heat the fixture up to a temperature at which the wax would melt so that the wax placed thereon becomes tacky. Frequently a fine tissue, such as a lens tissue, is placed on the fixture, and the wafer is pressed against the tissue with a force sufficient to squeeze excess wax out from behind the wafer. The fixture is then cooled to solidify the wax which therefore holds the wafer firmly to the fixture. After this, excess wax frequently has to be removed using a chlorinated solvent or perhaps a vapor degreaser. The fixtured wafers are then ready for machining. After lapping, the fixture first has to be reheated up to the temperature at which the wax became soft to allow the wafer to be removed from the fixture by sliding it sideways. However, abrasive particles yet embedded in the wax, frequently at this point scratch the wafer. Also, without the exercise of extreme care the thin wafer can be easily broken. Even after the wafers are successfully removed from the fixture, the wafer has to be cleaned by a degreasing operation or the like to remove all wax yet embedded in the crevices of the wafer; and in many cases using an ultrasonic vapor degreaser, wafer breakage can occur. Further, the fixture has to be cleaned and prepared again for subsequent lapping of different wafers.

The vacuum system of fixturing the wafer requires special equipment including ported fixtures, conduits or the like from each fixture, and vacuum apparatus with pump and valve means. Further the system is effective only so long as the wafer and the vacuum face on the fixture are extremely clean, and further where the wafer is flat and flush against the vacuum face. Thus dirt trapped between the wafer and the vacuum face could accidentally cause vacuum break down and allow release of the wafer. This is true also if the wafer is not flat, or does not completely cover the ports of the vacuum face. Further, in a multiple wafer fixture, if the vacuum is lost on one of the wafers, it generally would mean that the vacuum would be lost on all of the wafers and all would come loose. Further, a very critical drawback to the vacuum system is the possibility, despite filters or the like, of allowing part of the abrasive lapping slurry to be sucked up into the vacuum apparatus which would shorten the life of the vacuum pump. As can readily be appreciated, the vacuum fixturing system has both a high capital cost and a high continuing cost.

One so-called waxless method of wafer fixturing requires that the circuit side of the wafer is first coated with a photo resist and then etching tape is placed against it to protect against possible contamination by the abrasive slurry. The wafer is then placed into a fixture pocket which is made out of a mylar material, and water was used with its surface tension to hold the wafer in the fixture. However, allowance has to be made for the tape thickness, and because of the uncertainty of this dimension, it is difficult to obtain close lapping tolerances for size and parallel. Moreover, extreme care is required so as not to trap any contaminants between the circuit side of the wafer and the tape itself. After machining, the etching tape has to be removed, generally by submerging the entire wafer in a bath of acetone which is quite dangerous and undesirable. Even then small pieces of etching tape sometimes remain on the wafer surface which require additional, more specific cleaning steps.

Another so-called waxless method of wafer fixturing forms the fixture pockets out of a lamina of polymeric material such as polyvinyl chloride which exhibits variable surface adhesion characteristics toward the wafer at varying temperature or other ambient conditions. The fixture is typically heated to provide adhesion for the positioned wafer, and lapping takes place with the fixture yet heated. After the machining, the wafer is separated from the fixturing by chilling the components, such as by bathing in icy water. This approach thus requires auxiliary equipment for heating the fixture initially and during the lapping, and for the cooling bath release of the wafer.

Various patents which disclose examples of prior wafer fixturing methods are U.S. Pat. Nos. 2,968,135; 3,304,662; 3,731,435; 4,132,037 and 4,141,180.

SUMMARY OF THE INVENTION

This invention provides an improved system for accurately and reliably fixturing thin wafers of a brittle material for use on most conventional lapping machines, and without special auxiliary equipment such as vacuum devices, heating, cooling, or cleaning means otherwise needed for pretreating or post-treating the fixture or wafers. This invention thereby minimizes investment capital and needed floor space. The wafer loading and unloading can be done quickly and easily in adjacent proximity to the lapping machine, can be done without scratching or contaminating the circuit side of the wafer, and further even broken or partial wafers that are not full sized and that would not totally fill the fixture pocket can yet be fixtured using the disclosed invention.

This invention provides for the use of a fixturing block that includes a pedestal and a fiber ring surrounding the pedestal, each being generally the shape of the wafer. Mounted on the front surface of the pedestal is a pad of a microcellular rigid foamlike material such as polyurethane, cellularurethane, pellon perforated pad K or even some hard styrofoam material or polystyrene. This material is generally firm but sufficiently soft to accept any discontinuity in the surface of the wafer and further is cellular having many internal open pores or cells. A hydroscopic liquid then is spread uniformly as a very thin layer or film onto the pad surface and the wafer is pressed into the pad to squeeze the liquid from behind it to almost zero thickness and into the pad cells. It is desirable during the pressing of the wafer into the pad to avoid any twisting motion which would cause rubbing of the wafer against the pad and possibly cause damage to the wafer. In this manner, the liquid in the pad cells across the entire interface between the wafer and the pad in effect establishes a vacuum that bonds the wafer snuggly against the pad. The liquid preferably is a carbowax polyethylene glycol, is water soluble, has high tension properties when the wafer is under pressure, and lastly tends to keep the abrasive slurry used in lapping from getting behind the wafer. A water jet directed between the wafer and pad provides for the easy release of the fixtured wafer or vacuum pick-up tool.

The preferred embodiment further provides that the fixture is multiple pocketed to simultaneously hold a plurality of separate wafers. As an example, a cluster of a central pocket and six surrounding pockets for a fixture total of seven is preferred for a conventional 3 inch diameter wafer and a lapping machine having pressure plate diameter of 12 inches. With a multiple pocket fixture, the pedestals themsevles are lapped coplanar, and after the pads are bonded onto the coplanar faces of the pedestal, the pads in turn are lapped coplanar. Wafer thickness adjustment means are provided on the fixture, preferably in the form of four adjusting diamond tip screws located peripherally of the fixture. By these means, the exact thickness to which the wafer is to be lapped can be initially set prior to the lapping cycle.

DETAILED DESCRIPTION OF THE INVENTION

Figure 1:
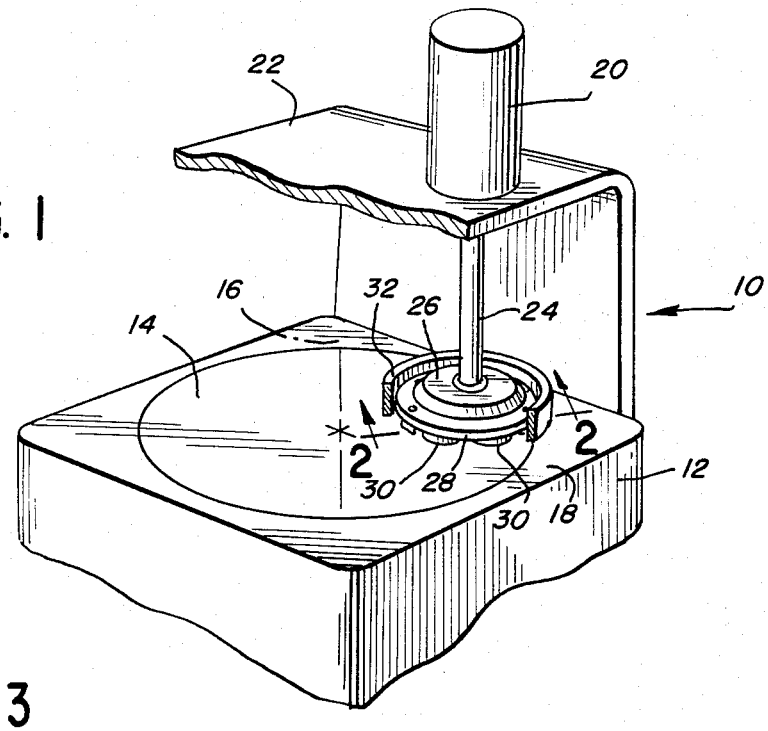
FIG. 1 is a perspective view of a lapping machine, and showing the subject wafer fixturing invention incorporated therein.

Referring to FIG. 1, the illustrated lapping machine 10 has a stationary frame 12 and a rotatable lap wheel 14. The wheel, generally shaped as a right angle cylindrical disc, is adapted to rotate about a center axis 16. The frame 12 includes a table-like surface 18 which surrounds the rotating lap wheel 14. A power cylinder 20 is mounted on an overlying portion 22 of the frame 12 and presents a rod or shaft 24 that rotatably and tiltably supports at its lower end a pressure plate 26. Operation of the power cylinder therefore raises the pressure plate with clearance well above the lap wheel 14 and lowers the pressure plate with adjustable forces almost against the lap wheel. Interposition between the pressure plate and the lap wheel is a fixture 28 which is suited to hold at least one and as illustrated several work pieces or wafer discs 30 which in turn rest against the lap wheel 14. A truing or retaining ring 32, slightly larger than both the pressure plate 26 and the fixture 28, fits freely over each to keep them together.

In general operation of the lapping machine 10, the wafers 30 are biased against the lap wheel 14 with adjustable axial compressive forces, and the lap wheel is rotated about the axis 16. This creates a lateral drag on the entire fixture 28, and of course abrades the surface of wafers contacting the lap wheel. Depending upon the abrasive grade of the lap wheel itself, the speed of rotation of the lap wheel, the pressure of the work pieces against the lap wheel, and the type of abrasive slurry used, the speed and degree of cut or wear of the work pieces can be selected as desired. Normal pressure contact would be in the one to three pound per square inch range, with a 12 micron abrasive slurry used for a preferred removal rate of approximately 5 to 15 microns per minute. This would be for a typical 3 inch diameter silicon work piece or wafer 30. The pressure plate 26 and underlying fixture 28 are free to rotate and swivel relative to supporting shaft or rod 24. Likewise, the retaining ring 32 is preferably supported to engage and rotate freely relative to the lap wheel 14. These features tend thereby to prevent the generation of grooves in the lap wheel caused by localized contact thereagainst of only the smaller work pieces or wafers, and also tend to maintain the lap wheel and wafers truer to parallel. Although only one power cylinder 20 and the resulting pressure plate 26 is illustrated in the lapping machine 10, it would be preferred and apparent that more than one such cylinder would be used at various circumferential locations about the center axis 16 of the lap wheel 14.

The lapping machine 10 is disclosed only for background information as to the forces incurred on the wafer work pieces 30 as they are held in the fixture 28 and as they engage the rotating lap wheel 14. As thus noted, during lapping the wafers 30 are subjected to a compressive force between the descending pressure plate and fixture and the underlying lap wheel 14. Further, the rotating lap wheel 14 moves relative to the wafers 30 to create shear forces between the wafers and the fixture 28. During this lapping operation the wafer fixturing should firmly hold the wafers and not allow any shifting relative to the fixture.

Figure 3:
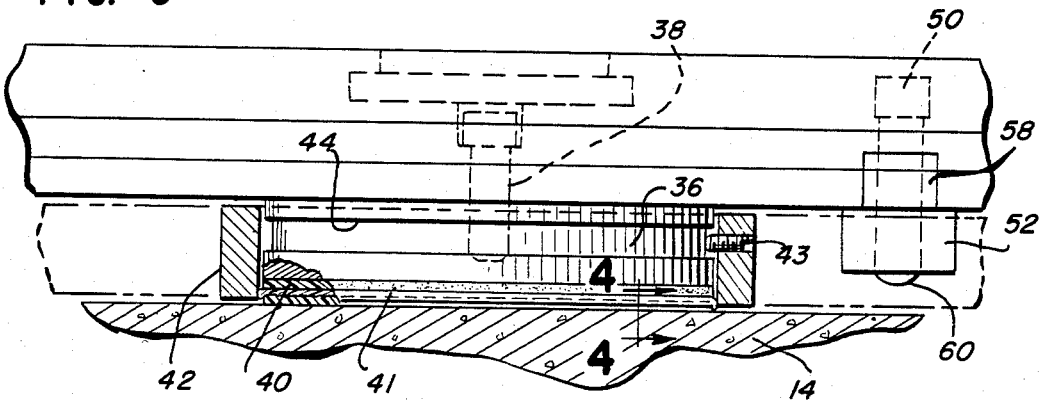
FIG. 3 is a sectional view across one of the fixture pockets, as seen generally from FIG. 2, but again with the orientation thereof inverted to correspond to the fixture as positioned in operation in the lapping machine of FIG. 1.
Figure 2:
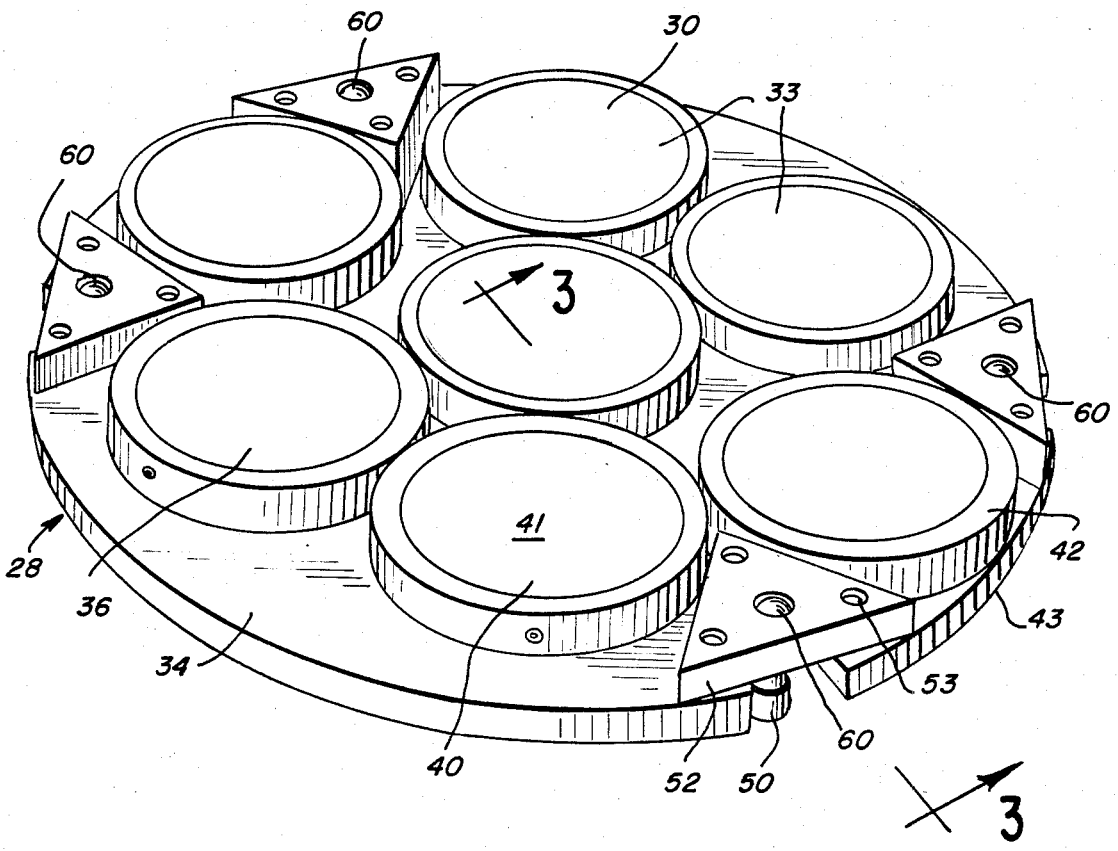
FIG. 2 is a perspective view of the wafer fixture used in the lapping machine of FIG. 1, except showing the fixture inverted as compared to its orientation in FIG. 1.

Referring now to FIG. 2, the fixture 28 is shown in isolated perspective inverted also as compared to FIGS. 1 and 3 showing then individual pockets 33 and secured wafers 30 in certain of the pockets. The fixture 28 is formed of a base plate 34, and each pocket 33 includes a pedestal 36 (see FIG. 3 for such details) sized generally to correspond to the size of the individual work piece or wafer 30 to be held in the fixture pocket. The pedestal is held by a screw 38 fitted through an opening in the base plate and threaded into a tap on the rear side of the pedestal. A pad 40 to be discussed in greater detail hereinafter is bonded to the exposed face of the pedestal 36 and itself has an exposed face 41 to which the work piece 30 is directly abutted. A guide ring 42, preferably of a softer plastic material, is sized to fit with slight clearance annularly about the wafer 30, pad 40 and pedestal 36. The guide ring is adjusted relative to the pedestal by set screw 43 threaded into the guide ring 42 and engaged against the pedestal 36, such as within an annular groove or recess 44, so as to project slightly beyond the exposed face of the pad 40 but less than by the finished thickness of the wafer after the lapping operation.

The fixture base plate 34 further has four spaced height adjusting screw members 50 which preferably are supported by means of brackets 52 secured by screws 53 to the base plate. Each adjustment screw 50 is threaded initially through a tap in the bracket 52 and is locked in place by means of a nut 58. The exposed surface 60 is preferably hard and smooth, such as a ground diamond tip. The screws 50 are adjusted at the four locations to position the exposed faces 41 of the pads at controlled adjusted heights above the true flat, which is symbolical of the lap wheel 14, and to determine the finished thickness of the wafers when the tips 60 bottom against the lap wheel.

Figure 4:
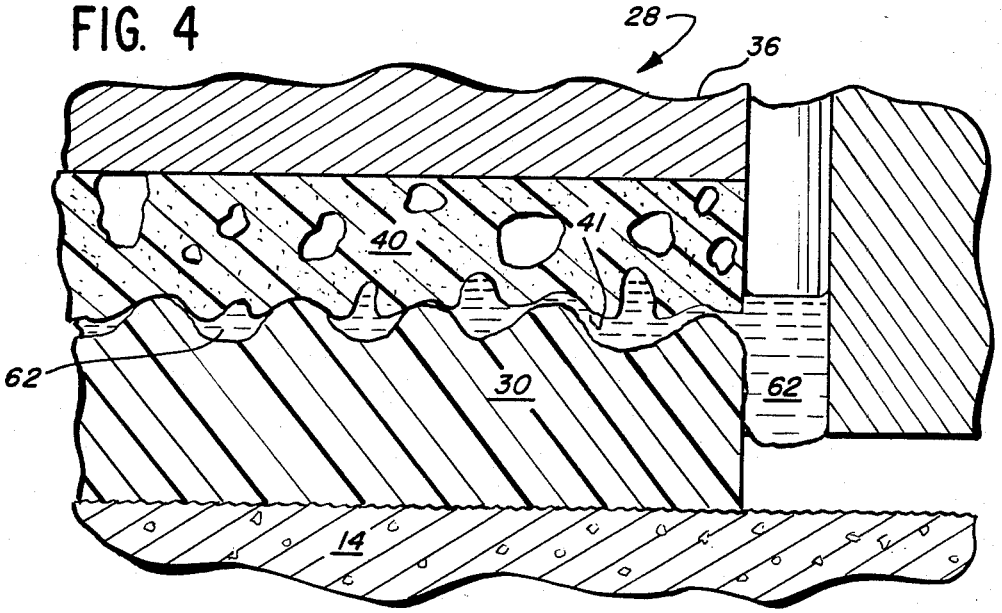
FIG. 4 is an enlarged sectional view as seen generally from line 4—4 in FIG. 3.

Referring now to FIGS. 3 and 4, a more detailed explanation of the subject invention will be given. Of particular interest is the composition of the pad 40 and its role in retaining the wafer relative to the fixture 28. Specifically, the pad 40 is formed of a microcellular rigid foam polyurethane which is selected for this purpose because of its general porosity and its softness or compressibility. The foam pad 40 thus has a large plurality of cellular pockets or voids therein which serve to allow a slight cushioning of the pad to prevent the brittle wafer from being damaged and further to absorb any surface irregularities on the circuit side of the wafer. For example, even contaminants in the form of dust or dirt can exist between the wafer and the pad surface 41 and be absorbed and/or compressed into the resilient foam pad.

To provide adhesion between the wafer 30 and the pad 40, several drops of a special liquid is put onto the pad surface 41 and spread out uniformly as a thin film 62 over the entire surface. The liquid preferred is manufactured by Union Carbide Corporation under the name carbo wax polyethylene glycol. This liquid is water soluble, but it is less hygroscopic than simple glycols and/or glycerines. However, these secondarily named products might suitably work also but are not preferred. This liquid also has high tension properties which serve to hold the positioned wafer in place firmly against the pad.

Regarding securing the wafer 30 to the pad 40, after the liquid has been put on the pad and uniformly spread across the pad surface as film 62, the wafer 30 is positioned against the pad and with a slight pressure is pressed uniformly against the pad. This compresses the liquid film 62 trapped between the wafer and the pad into the open cells of the pad and reduces the film in effect to near zero thickness at other locations. Upon removal of the pressure from the wafer, the liquid in the cells tends to in effect form a vacuum for retaining the wafer in snug contact against the pad. This not only holds the wafer from vertically dropping away from the pad but further prevents shearing, twisting or rotating movement relative to the pad.

The wafer is removed from the confinement of the fixture pocket 33 merely by flushing the work piece out with a filtered water solution, preferably a deionized solution, by means of a moderate velocity jet or pick directed under an edge of the wafer. Alternatively, a tweezer can be used to grip an edge of the wafer and slide it sideways away from the pad, or a vacuum-type pick-up tool may be utilized.

In the preferred construction, the base plate 34 is formed of aluminum that is hard coat anodized to prevent damage because of the continual exposure to tap water, abrasive slurry or the like. This is likewise true of the pedestal 36. The mounting brackets 52 are preferably formed of a more durable stainless steel, and as noted, the adjustment screws 50 have diamond tips 60 for durability and hardness.

In the preferred operation of the entire multiple pocket fixture and the concept of the invention, the pedestal surfaces are first lapped coplanar relative to one another on the lapping machine. The pads 40 are then bonded to the flat planar side of the pedestal by a suitable adhesive, which might be 3M Corporation adhesive No. 1357, for example, applied initially to both surfaces until tacky and then contacting the tacky surfaces together. Alternatively, it is possible to use a two-part epoxy which is well known in the art. The pads themselves are then lapped coplanar on the lapping machine. The locator rings 42 are then adjusted to allow for the size of the finished wafer 30 plus any tolerances that might be required plug the abrasive allowance which typically is quite small. Care must be taken of course to maintain dirt or dust particles from collecting in any of the finished surfaces; and this can be done with a soft bristle brush or with an air hose discharge. The liquid is then placed on the pedestal pad face 41, preferably with the fixture inverted as in FIG. 2, which is noted may take several drops for a 3 inch diameter wafer; and carbo wax polyurethane glycol liquid is preferred. The liquid is spread out uniformly over the entire surface of the pad. The clean circuit side of the wafer is then placed under light pressure against the pad to establish a uniform contact thereagainst. The guide ring 42 positions the wafer properly and in full contact with the pad surface 41. In effect the liquid is spread out to a near zero thickness and is forced into the pores of the pad itself; and the material of the pad is sufficiently soft to absorb any discontinuities in the normal smoothness of the circuit side of the wafer. As noted the liquid film squeezed into the pores of the pad material creates a vacuum that holds the wafer firmly against the pad and precludes movement of the wafer relative to the pad. The guide ring serves further to help maintain a seal in combination with the hygroscopic liquid that precludes the possible migration of the abrasive slurry during the lapping operation up into contact with the circuit side of the wafer.

After each wafer is loaded in this manner, the entire fixture is positioned in place on the lapping machine 10 and the lapping cycle is set to begin. The operating machine then removes the stock at the controlled rate and the pressure is built up in the power cylinder as required to approximately one to three psi which generally gives the best stock removal. The micron size of the lap wheel as well as the abrasive slurry can be selected to accomplish the stock removal from the wafers. At the end of the cycle, the truing and retaining ring 32 is removed and the entire fixture 28 is likewise moved from contact with the lap wheel by a slight sliding and upward movement. This maintains the wafers in the individual pockets. The individual wafers in turn are then removed from the pockets by a water jet or pick flush and/or with the use of tweezers. The finished wafers further can be rinsed with water and stacked in a water filled cassette, for example, for additional washing and/or cleaning preparatory to subsequent handling and fabrication.

Note that this disclosed form of fixturing wafer-like work pieces 30 within the fixture 28 requires very little capital investment and further does not need added floor space for special equipment such as heaters, vacuum pumps, valves or ported fixtures used in the prior art. The speed of loading and unloading the wafers 30 is quite impressive and further can be done at the machine site, needing only a simple water tap and drain or the like for easing the removal. Further there is no extensive clean up required on either the lapped wafers themselves or on the fixture. Because the pieces are easily released from the fixture and need no elaborate post treating or cleaning, scratching of the circuit surface is almost eliminated entirely. Further, it is possible by use of the guide ring 42 to accept even broken wafers provided there is sufficient surface contact of the wafer against the guide ring to prevent sliding or the like of the damaged wafer.

Of particular importance also is the cooperation of the guide ring 42 and the adhesive liquid to one another in order to keep the abrasive slurry from migrating to the circuit side of the wafer during the lapping operation. As has alredy been noted, the ring fits with reasonably close clearance, e.g., only several thousandths of an inch gap, relative to the pad and the wafer. The excess liquid squeezed out from between the wafer 30 and pad surface 41 tends to lap this gap and thereby in effect forms a seal with the ring 42.

A pad 40 having a thickness of the order of 0.040" worked most effectively with a three inch diameter silicon wafer 30 having a starting thickness of the order of 0.020" and a finished or lapped thickness of the order of 0.008".

While this disclosure has been directed with particular emphasis towards silicon wafers, it is quite likely that wafers of other brittle crystalline materials such as sapphire, garnet or even glass could adequately be used with this particular lapping fixture. Further, it is quite likely that metal parts, such as for metal mirrors, could quite advantageously be used in the subject fixture.

What is claimed is:

1. A fixture for use with a lapping machine to hold a plurality of thin generally flat wafers against a lapping wheel during a lapping operation, said fixture comprising, in combination, a baseplate, a plurality of round pedestal disc members of a diameter corresponding approximately to said wafers and secured to said baseplate in spaced relation to each other, a plurality of round pads of firm but resilient foam-like cellular material having internal open cells, one pad being secured to each pedestal surface to substantially cover the same, each pad having an exposed surface machined to match said lapping wheel surface to effect parallelism therewith, and a plurality of rings with one ring removably secured to each of said pedestals to closely surround and project beyond the surface of a corresponding one of said pads, said rings serving to assist in mounting each wafer centrally on a corresponding pad, and said rings also serving to cooperate with a corresponding pad so when said pad is wetted with a hygroscopic liquid and a wafer is pressed against the pad, said ring in combination with the hygroscopic liquid will aid in maintaining a seal to prevent abrasive slurry used in the lapping operation from entering the pad and damaging the side of the wafer opposite the side being lapped.

2. A fixture as defined in claim 1 where each ring is adjustably mounted on a corresponding pedestal by the use of removable set screw means.

3. A fixture as defined in claim 1 where said pedestals are made of metal and said rings are made of plastic.

4. A fixture as defined in claim 1 where said pad material is micro-cellular rigid foam polyurethane.

5. A fixture as defined in claim 1 including a plurality of adjustable stop means affixed to said baseplate which project beyond the height of said rings and serve to control the finished thickness of said wafers during a lapping operation.

* * * * *